US011841126B2

(12) United States Patent
Huang et al.

(10) Patent No.: US 11,841,126 B2
(45) Date of Patent: Dec. 12, 2023

(54) LIGHT DISTRIBUTION ASSEMBLY AND ILLUMINATION DEVICE

(71) Applicants: SUZHOU OPPLE LIGHTING CO., LTD., Suzhou (CN); OPPLE LIGHTING CO., LTD., Shanghai (CN)

(72) Inventors: Junhui Huang, Suzhou (CN); Lei Zheng, Suzhou (CN); Yong Xue, Suzhou (CN)

(73) Assignees: SUZHOU OPPLE LIGHTING CO., LTD., Jiangsu (CN); OPPLE LIGHTING CO., LTD., Shanghai (CN)

( * ) Notice: Subject to any disclaimer, the term of this patent is extended or adjusted under 35 U.S.C. 154(b) by 0 days.

(21) Appl. No.: 17/508,761

(22) Filed: Oct. 22, 2021

(65) Prior Publication Data

US 2022/0049838 A1 Feb. 17, 2022

Related U.S. Application Data

(63) Continuation of application No. PCT/CN2020/085811, filed on Apr. 21, 2020.

(30) Foreign Application Priority Data

Apr. 25, 2019 (CN) ..... 201910341175.1
Apr. 25, 2019 (CN) ..... 201910341187.4
(Continued)

(51) Int. Cl.
*F21V 14/06* (2006.01)
*F21V 7/04* (2006.01)
(Continued)

(52) U.S. Cl.
CPC ..... *F21V 14/06* (2013.01); *F21V 5/008* (2013.01); *F21V 5/02* (2013.01); *F21V 7/04* (2013.01);
(Continued)

(58) Field of Classification Search
CPC ..... F21V 23/005; F21V 14/06; F21V 14/065; F21V 5/008; F21V 5/02; F21V 7/0091; F21V 13/04
See application file for complete search history.

(56) References Cited

U.S. PATENT DOCUMENTS 7,217,002 B2 * 5/2007 Jungel-Schmid ..... F21S 10/007 362/147
10,247,384 B1 * 4/2019 Feinbloom ..... F21V 17/12
(Continued)

FOREIGN PATENT DOCUMENTS

CN 104456424 A 3/2015
CN 108716655 A 10/2018
(Continued)

OTHER PUBLICATIONS

International Search Report of PCT Application No. PCT/CN2020/085811 dated Jul. 21, 2020 with English translation, (6p).

*Primary Examiner* — Colin J Cattanach
(74) *Attorney, Agent, or Firm* — Arch & Lake LLP

(57) ABSTRACT

The present disclosure discloses a light distribution assembly and a lighting device, belonging to the technical field of lighting. The light distribution assembly includes a first lens, a second lens, a first kit, and a second kit; the first lens is disposed on the first kit, the second lens is disposed on the second kit, the second kit is connected to the first kit and is rotatable relative to the first kit to allow the second lens to be rotatable relative to the first lens, and at least one of the
(Continued)

first lens and the second lens is a polarizing lens to change a light distribution path of the light distribution assembly.

20 Claims, 8 Drawing Sheets

(30) Foreign Application Priority Data

Apr. 25, 2019 (CN) ..... 201920581335.5
Apr. 25, 2019 (CN) ..... 201920581393.8

(51) Int. Cl.

| | |
|---|---|
| ***F21V 9/14*** | (2006.01) |
| ***F21V 17/02*** | (2006.01) |
| ***F21V 5/02*** | (2006.01) |
| ***F21V 5/00*** | (2018.01) |
| ***F21V 13/04*** | (2006.01) |
| ***F21V 23/00*** | (2015.01) |
| ***F21V 7/00*** | (2006.01) |

(52) U.S. Cl.
CPC ..... *F21V 9/14* (2013.01); *F21V 17/02* (2013.01); *F21V 7/0091* (2013.01); *F21V 13/04* (2013.01); *F21V 14/065* (2013.01); *F21V 23/005* (2013.01)

(56) References Cited

U.S. PATENT DOCUMENTS 10,690,316 B1* 6/2020 Feinbloom ..... F21L 4/00
2006/0187654 A1* 8/2006 Jungel-Schmid ..... F21S 10/007 362/147
2009/0323203 A1* 12/2009 Adams ..... G02B 7/1805 359/837
2010/0118550 A1* 5/2010 Kuo ..... G02B 7/02 359/818
2012/0257278 A1* 10/2012 Simonov ..... G11B 7/13927 359/557
2014/0168996 A1* 6/2014 Kajiwara ..... F21S 41/29 362/311.02
2015/0204504 A1* 7/2015 Suwa ..... F21S 41/26 362/514
2015/0267888 A1* 9/2015 Suwa ..... F21S 41/635 362/512
2016/0018085 A1* 1/2016 Van Thiel ..... F21V 5/045 362/268
2016/0363288 A1* 12/2016 McKendry ..... F21V 5/007
2016/0377256 A1* 12/2016 Hansen ..... F21V 13/04 362/268
2016/0377265 A1* 12/2016 Hansen ..... F21V 9/40 362/268
2017/0050555 A1* 2/2017 Chen ..... B60Q 1/245
2017/0146639 A1* 5/2017 Carothers ..... G01S 7/4817
2017/0268749 A1* 9/2017 Pet ..... G02B 26/123
2019/0093861 A1* 3/2019 Xu ..... F21V 31/005
2020/0240612 A1* 7/2020 Bremerich ..... F21V 5/04
2021/0255004 A1* 8/2021 Heishi ..... F21S 41/63
2021/0263301 A1* 8/2021 Oshima ..... G03B 21/142

FOREIGN PATENT DOCUMENTS

CN 108803040 A 11/2018
CN 10081391 A 8/2019
CN 110081392 A 8/2019
CN 209587959 U 11/2019
CN 209655212 U 11/2019
DE 202014003076 U1 * 5/2014 ..... F21V 17/16
JP H11167079 A 6/1999
JP 2001337370 A 12/2001

* cited by examiner

LIGHT DISTRIBUTION ASSEMBLY AND ILLUMINATION DEVICE

CROSS-REFERENCE TO RELATED APPLICATIONS

This application is based upon and claims the priority of PCT patent application No. PCT/CN2020/085811 filed on Apr. 21, 2020, and this application further claims the priority of Chinese patent application No. 201910341187.4, filed on Apr. 25, 2019, Chinese patent application No. 201920581393.8 filed on Apr. 25, 2019, Chinese patent application No. 201910341175.1 filed on Apr. 25, 2019, and Chinese patent application No. 201920581335.5 filed on Apr. 25, 2019; and the entire disclosure of the above applications is incorporated herein by reference in their entirety for all purposes.

TECHNICAL FIELD

The present disclosure relates to the technical field of lighting, and in particular to a light distribution assembly and a lighting device.

BACKGROUND

A lighting device may include a base and a light-emitting assembly located in an accommodation cavity of the base. In order to allow the angle of emitting light to be adjusted, the light-emitting assembly needs to be selected around the rotation axis, so that the light-emitting assembly can rotate relative to the base in the accommodation cavity.

SUMMARY

The present disclosure provides a light distribution assembly and a lighting device.

The light distribution assembly is provided by the present disclosure. The light distribution assembly may include a first lens, a second lens, a first kit, and a second kit, the first lens may be disposed on the first kit, the second lens may be disposed on the second kit, the second kit may be disposed on the first kit and may be rotatable relative to the first kit to allow the second lens to be rotatable relative to the first lens, and at least one of the first lens and the second lens may be a polarizing lens to change a light distribution path of the light distribution assembly.

The present disclosure provides a lighting device, and the lighting device may include a base, a light-emitting assembly, and the light distribution assembly described above; the base may include a light outlet, an accommodation cavity communicated with the light outlet, and a bottom wall opposite to the light outlet; the light-emitting assembly may be disposed in the accommodation cavity and may emit light towards the light outlet; and the light distribution assembly may be connected to the base and may be close to the light outlet relative to the light-emitting assembly to distribute light for the light-emitting assembly.

It is to be understood that both the foregoing general description and the following detailed description are exemplary and explanatory only and are not restrictive of the present disclosure.

BRIEF DESCRIPTION OF THE DRAWINGS

The drawings described herein are used to provide a further understanding of the present disclosure and constitute a part of the present disclosure. The schematic examples of the present disclosure and descriptions thereof are used to illustrate the present disclosure and are not limitative to the present disclosure. In the drawings.

DETAILED DESCRIPTION

Figure 1:
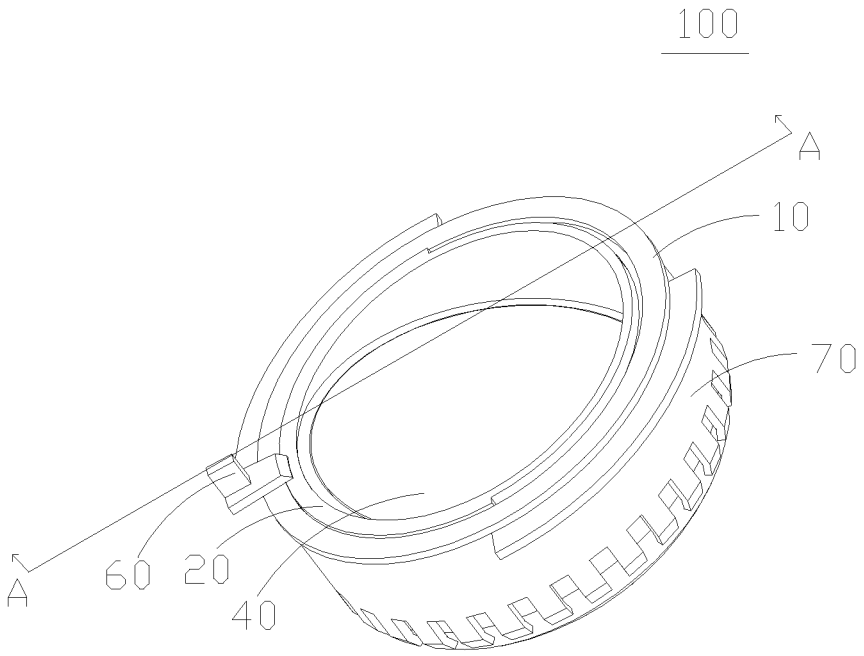
FIG. 1 is a structural diagram of a light distribution assembly in an example 1 of the present disclosure.

In order to make objects, technical details and advantages of the present disclosure apparent, the technical solutions of the present disclosure will be described in a clearly and fully understandable way in connection with the examples of the present disclosure and the drawings related to the examples of the present disclosure. Apparently, the described examples are just a part but not all of the examples of the present disclosure. Based on the described examples of the present disclosure herein, those skilled in the art can obtain other example(s), without any inventive work, which should be within the protection scope of the present disclosure.

Reference numerals used in this disclosure may include:

100—light distribution assembly;

10—first kit; 11—first-section inner wall; 12—first limiting surface; 13—second-section inner wall; 131—first annular groove; 14—second limiting surface;

20—second kit; 21—second inner wall; 22—third limiting surface; 23—second clamping connection outer wall; 231—second annular groove;

30—first lens; 31—first light-incident surface; 32—first light-emitting surface; 33—first outer wall; 34—first clamping portion;

40—second lens; 41—second light-incident surface; 42—second light-emitting surface; 43—second outer wall; 44—axial positioning surface; 45—second clamping portion;

50—elastic part;

60—driving part; 61—radial extension portion; 62—axial extension portion;

70—mounting kit; 71—mounting body; 72—mounting flange; 73—mounting claw;

200—lighting device;

210—base; 211—light outlet; 212—accommodation cavity; 213—bottom wall; 214—peripheral sidewall; 2141—internal thread; 215—connecting flange; 216—third clamping connection portion; 217—stop portion; 218—shrapnel mounting portion;

220—light source module; 221—light source plate; 222—light-emitting unit; 231—power board; 232—component;

240—third lens; 241—third light-incident surface; 242—third light-emitting surface;

251—lens mounting part; 2511—guiding portion; 252—lens fixing part; 2521—fourth limiting surface; 2522—external thread; 2523—anti-glare surface;

260—surface ring; 261—side ring wall; 2611—first guiding portion; 2612—third clamping portion; 2613—second guiding portion; 2614—fourth clamping portion; 2615—notch; 262—bottom ring surface;

270—reflector; 271—reflection body; 272—fourth clamping connection portion.

Sometimes, because the current adjustment of the light-emitting assembly relative to the base is a mechanical adjustment of the entire light-emitting assembly, the adjustment for the angle of emitting light is not convenient enough and the effect is not ideal.

Figure 2:
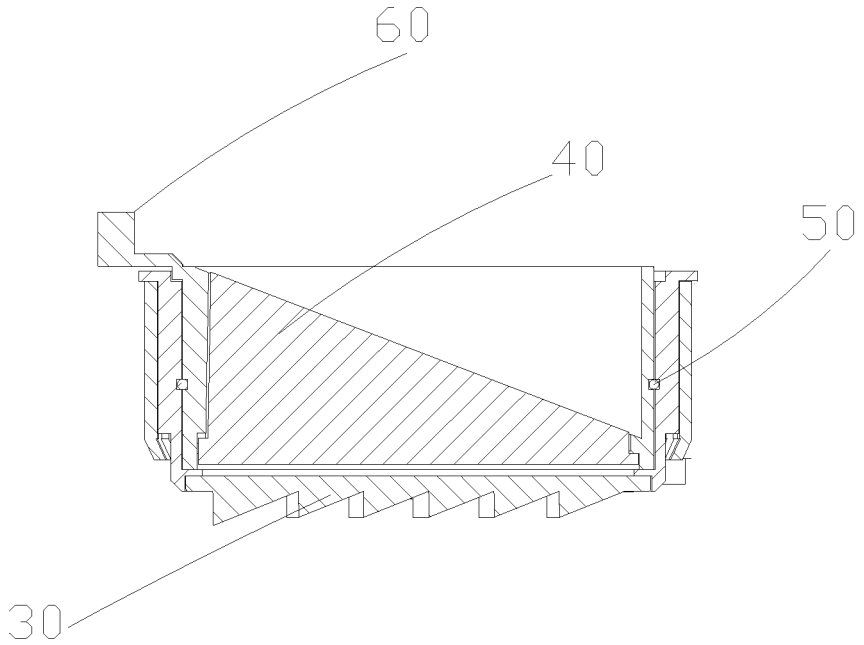
FIG. 2 is a cross-sectional view of the light distribution assembly in FIG. 1 along a line A-A.
Figure 3:
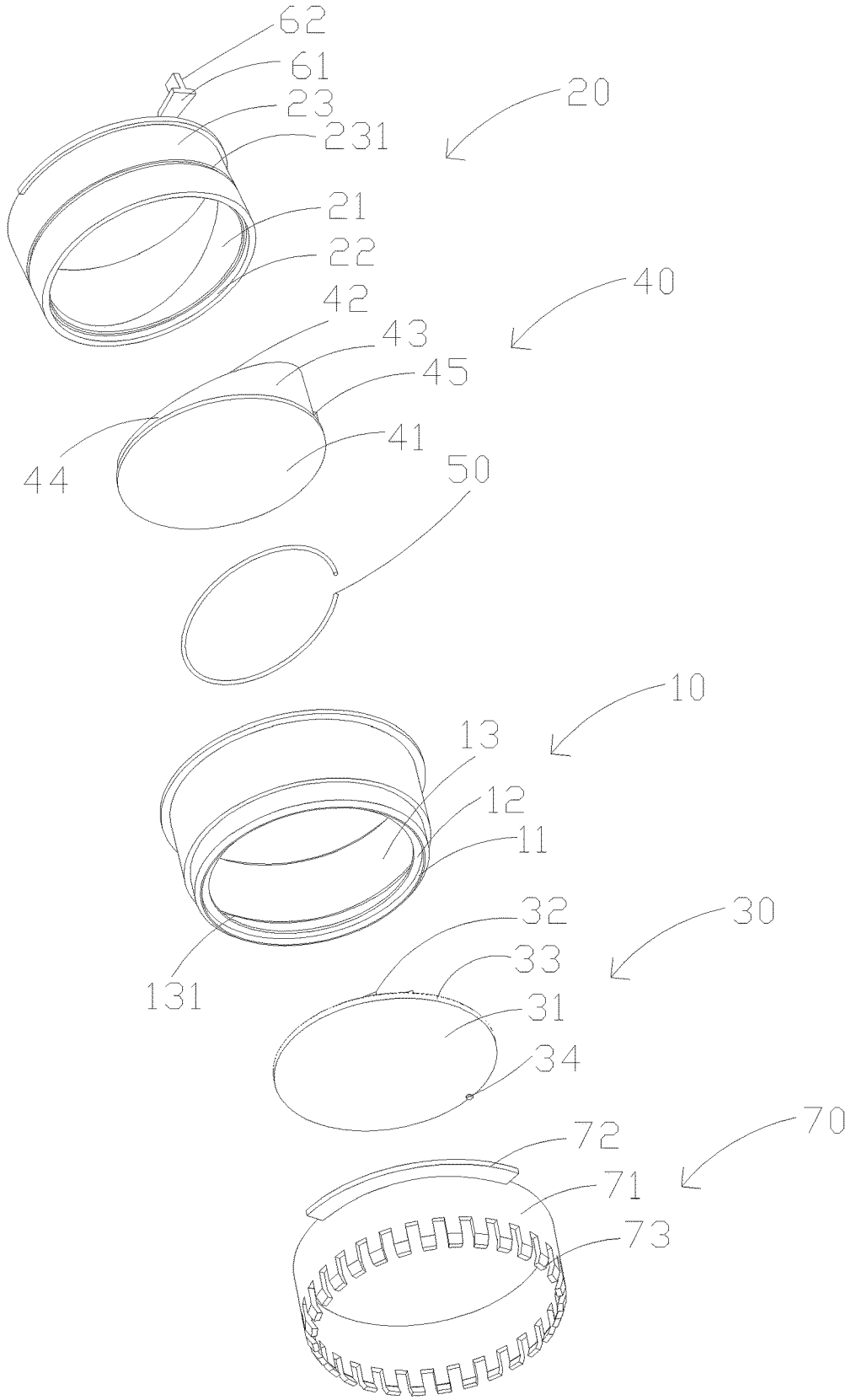
FIG. 3 is an exploded view of the light distribution assembly in FIG. 1.

As illustrated in FIG. 1 to FIG. 3, an example 1 of the present disclosure provides a light distribution assembly 100 which includes a first lens 30, a second lens 40, a first kit 10, and a second kit 20.

The first lens 30 is arranged on the first kit 10, the second lens 40 is arranged on the second kit 20, and the second kit 20 is arranged on the first kit 10 and is rotatable relative to the first kit 10. Because the first kit 10 is rotatable relative to the second kit 20, the second lens 40 can rotate relative to the first lens 30. At least one of the first lens 30 and the second lens 40 is a polarizing lens, and in the case that the position of the light source module 220 (FIG. 6) remains unchanged and one of the polarizing lenses rotates relative to the other lens, the polarizing lens rotates relative to the light source module 220, and the non-polarizing lens can remain stationary relative to the light source module 220, that is, the light distribution path of the light distribution assembly 100 can be changed, so as to change the angle of emitting light.

Specifically, one of the first lens 30 and the second lens 40 may be a polarizing lens and the other may be a common non-polarizing lens. If the second lens 40 is a polarizing lens, the deflection direction of the optical path passing through the light distribution assembly 100 can be changed by rotating the second lens 40. In the case that both the first lens 30 and the second lens 40 are polarizing lenses, the deflection angle and deflection direction of the optical path passing through the light distribution assembly 100 can be changed by rotating one of the second lens 40 or the first lens 30.

It should be noted that in the examples of the present disclosure, the second lens 40 is rotatable relative to the first lens 30, which means that in actual use, the first lens 30 may be driven to rotate and the second lens 40 may be driven to remain stationary, or the first lens 30 may be driven to remain stationary and the second lens 40 may be driven to rotate, specifically based on being able to change the light distribution path of the light distribution assembly 100.

Specifically, the second kit 20 may be sleeved in the first kit 10, so that the second kit 20 is rotatable in the first kit 10, and the central axis of the first lens 30 and the central axis of the second lens 40 are collinear. The second kit 20 and the first kit 10 may not be sleeved and connected with each other, but both are sleeved on the same object to achieve relatively rotatable setting.

The first lens 30 includes a first light-incident surface 31 and a first light-emitting surface 32, and the second lens 40 includes a second light-incident surface 41 and a second light-emitting surface 42. The first light-emitting surface 32 is arranged parallel to the second light-incident surface 41, and the spacing between the first light-emitting surface 32 and the second light-incident surface 41 may be small, so as to reduce the loss of light between the first lens 30 and the second lens 40.

For example, the rotation range of the first lens 30 may be 10 degrees to 360 degrees, specifically, 30 degrees, 60 degrees, 90 degrees, 180 degrees, etc. The rotation range is related to the emitting angle of the light to be adjusted and the range of the irradiation target area.

It should be noted that the above axis is a virtual line, and the above axis does not exist in the actual product of the light distribution assembly 100. In addition, the relatively rotatable mechanical structure may be achieved by the conventional technology in the art, and details will not be described here.

Taking the rotation route of the first lens 30 as 360 degrees as an example, one of the first lens 30 and the second lens 40 may be a polarizing lens, and no matter which position the first lens 30 rotates to, the light emitted through the light distribution assembly 100 is deflected, that is, the light distribution assembly 100 of the examples of the present disclosure is a polarizing assembly. At this time, if the deflection angle of the first lens 30 is large, the irradiation trajectory of the light emitted by the light source and through the light distribution assembly 100 may be circular, that is, the light cannot irradiate directly in front of the light distribution assembly 100. If both the first lens 30 and the second lens 40 are polarizing optical elements, the light distribution assembly 100 may be a non-polarizing lens at some angles.

It should be noted that in the examples of the present disclosure, the first lens 30 is rotatable relative to the second lens 40, which means that in actual use, the first lens 30 may be driven to rotate and the second lens 40 may be driven to remain stationary, or the first lens 30 may be driven to remain stationary and the second lens 40 may be driven to rotate, specifically based on being able to change the light distribution path of the light distribution assembly 100.

In order to reduce the volume of the light distribution assembly 100 and reduce the light attenuation, the first light-emitting surface 32 and the second light-incident surface 41 are arranged in parallel, so that the first light-emitting surface 32 and the second light-incident surface 41 can be arranged at a close distance, that is, most of the emitting light of the first light-emitting surface 32 can enter the second lens 40 through the second light-incident surface 41. In some examples, the first light-emitting surface 32 and the second light-incident surface 41 may form an included angle.

In order to further reduce the light attenuation, the orthographic projection of the first light-emitting surface 32 on the second light-incident surface 41 overlaps with the second light-incident surface 41, which can ensure that all the light emitted from the first light-emitting surface 32 can enter the second lens 40 through the second light-incident surface 41. In some examples, due to the special requirements for light deflection, the orthographic projection of the first light-emitting surface 32 on the second light-incident surface 41 may partially overlap with the second light-incident surface 41, or may not overlap with the second light-incident surface 41.

The first light-emitting surface 32 and the second light-incident surface 41 may be flat surfaces, so that the first lens 30 and the first lens 40 can be assembled at a close distance and the volume of the light distribution assembly 100 can be reduced. In some examples, the first light-emitting surface 32 may be a curved surface, a serrated surface, a wedge-shaped surface, etc., and the second light-incident surface 41 may also be a curved surface, a serrated surface, a wedge-shaped surface, etc.

The distance between the first light-emitting surface 32 and the second light-incident surface 41 may be between 1 mm and 10 mm, such as 2 mm, 3 mm, 5 mm, 8 mm, etc. In practical applications, the distance between the first light-emitting surface 32 and the second light-incident surface 41 should be as small as possible without affecting the assembly.

The first lens 30 further includes the first light-incident surface 31 arranged opposite to the first light-emitting surface 32, and the second lens 40 further includes the second light-emitting surface 42 arranged opposite to the second light-incident surface 41. During the rotation of the first lens 30 relative to the second lens 40, the included angle between the surface where the first light-incident surface 31 is located and the surface where the second light-emitting surface 42 is located changes, so as to change the deflection angle of the light distribution path of the light distribution assembly 100.

Figure 9:
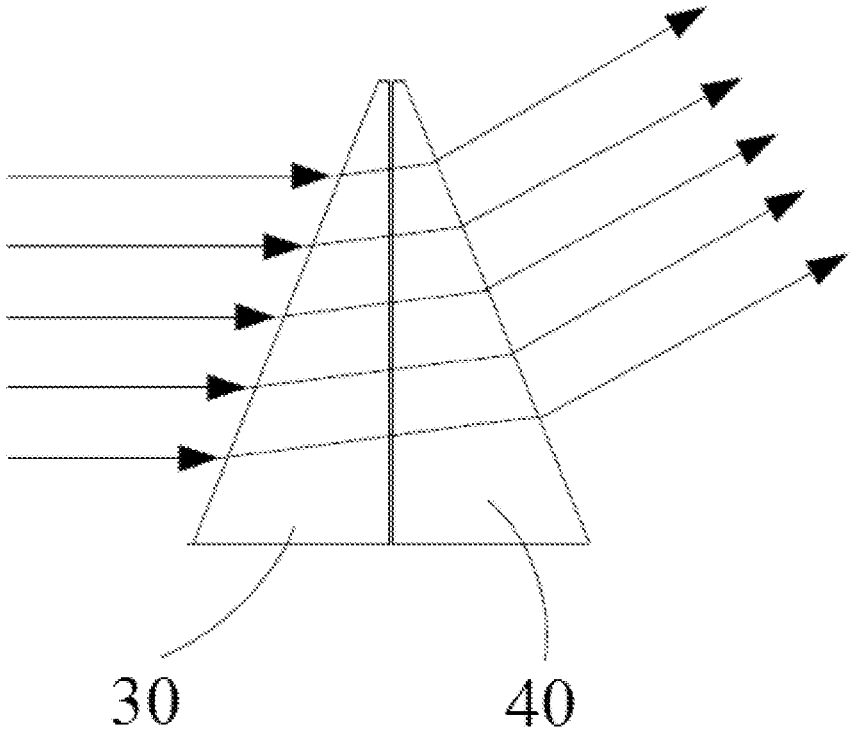
FIG. 9 is a diagram of a light distribution path in the case that a surface where a first light-incident surface is located and a surface where a second light-emitting surface is located form a first included angle.
Figure 10:
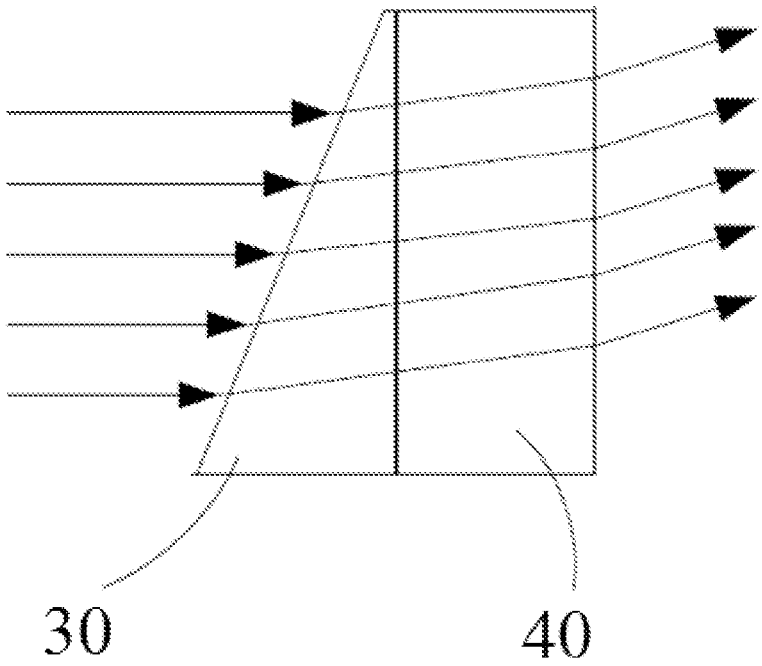
FIG. 10 is a diagram of a light distribution path in the case that a surface where the first light-incident surface is located and a surface where the second light-emitting surface is located form a second included angle.
Figure 11:
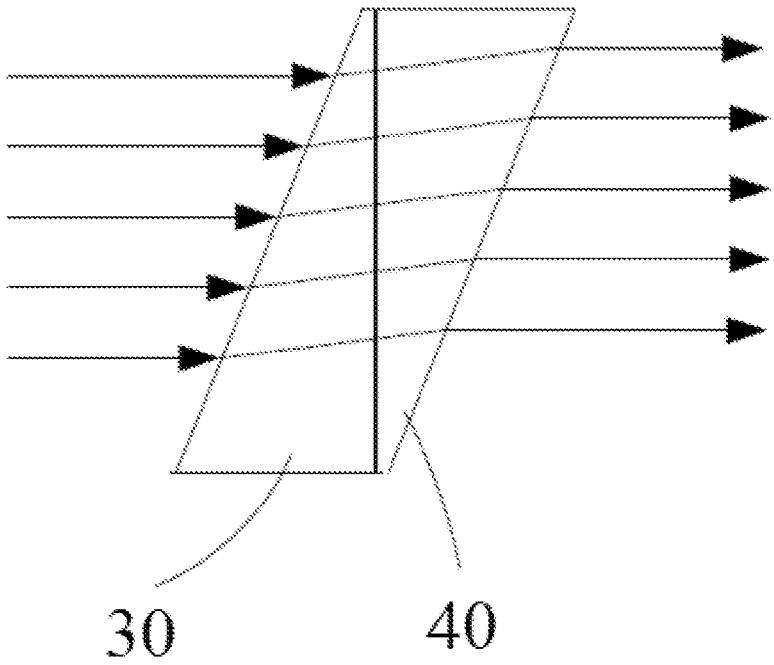
FIG. 11 is a diagram of a light distribution path in the case that the first light-incident surface and the second light-emitting surface are parallel to each other.

As illustrated in FIG. 9, the first light-emitting surface 32 and the second light-incident surface 41 are arranged in parallel. At this time, the included angle between the surface where the first light-incident surface 31 is located and the surface where the second light-emitting surface 42 is located is the first included angle, the first included angle is the maximum included angle that can be formed by the surface where the first light-incident surface 31 is located and the surface where the second light-emitting surface 42 is located, and the deflection angle of the light distribution path of the light distribution assembly 100 is also the largest. As illustrated in FIG. 10, at this time, the included angle between the surface where the first light-incident surface 31 is located and the surface where the second light-emitting surface 42 is located is the second included angle, the second included angle is smaller than the first included angle, and the deflection angle of the light distribution path of the light distribution assembly 100 is smaller than that in FIG. 9. As illustrated in FIG. 11, at this time, the first light-incident surface 31 and the second light-emitting surface 42 are parallel to each other, that is, the included angle between the two surfaces is zero, the light distribution path of the light distribution assembly 100 has no angular deflection, and the light distribution assembly 100 is a non-polarizing assembly, but the light emitted through the light distribution assembly 100 is translated as a whole. Specifically, in FIG. 11, the emitting light is translated upward as a whole compared to the incident light.

In order to enable the light distribution assembly 100 to have the function of not deflecting the emitting light during use and to facilitate modular processing, the first lens 30 and the second lens 40 may be the same optical elements and may be symmetrically assembled to form the light distribution assembly 100. As illustrated in FIG. 9 to FIG. 11, the first lens 30 and the first lens 40 are the same optical elements, which are symmetrically arranged in FIG. 9. In FIG. 11, the first light-incident surface 31 and the second light-emitting surface 42 may be parallel to each other.

The polarizing lens of the examples of the present disclosure includes the first lens 30 and the second lens 40. The first lens 30 and the second lens 40 may be a serrated polarizing lens, a wedge-shaped polarizing lens, a curved polarizing lens, or a polarizing lens formed by a combination of at least two of a serrated polarizing lens, a wedge-shaped polarizing lens, and a curved polarizing lens, as well as other lenses capable of deflecting light. Specifically, in addition to the surface facing the second lens, the other opposite surface of the first lens may be a serrated surface, a curved surface, a wedge-shaped surface, etc. In addition to the surface facing the first lens, the other opposite surface of the second lens may be a serrated surface, a curved surface, a wedge-shaped surface, etc.

Specifically, two polarizing lenses may be wedge-shaped polarizing lenses or serrated polarizing lenses with a serrated surface. In the examples of the present disclosure, the first lens 30 is a serrated polarizing lens, and the second lens 40 is a wedge-shaped polarizing lens. Specifically, the first light-incident surface 31 is serrated, and the second light-emitting surface 42 forms an included angle with the second light-incident surface 41 and the first light-emitting surface 32. As a deformation, both the first lens 30 and the second lens 40 may be wedge-shaped polarizing lenses, serrated polarizing lenses, or a combination of other types of polarizing lenses, which will not be repeated.

The first lens 30 includes the first outer wall 33 extending from the edge of the first light-emitting surface 32 towards the first light-incident surface 31. The first kit 10 includes the first-section inner wall 11 and the first limiting surface 12. The first limiting surface 12 extends inward along the direction of the first kit 10, and the first-section inner wall 11 fits the first outer wall 33. The first limiting surface 12 fits the edge of the first light-emitting surface 32 to define the axial position of the first lens 30 in the first kit 10.

In order to define the circumferential position of the first lens 30 in the first kit 10, the first lens 30 is provided with the first clamping portion 34, the first kit 10 is provided with the first clamping connection portion (not shown), and the first clamping portion 34 is clamped with the first clamping portion 34. Specifically, the first clamping portion 34 is arranged at the edge of the first light-emitting surface 32 and extends along the axial direction, the first clamping connection portion is arranged on the first limiting surface 12 and extends along the axial direction, one of the first clamping portion 34 and the first clamping connection portion is a protrusion, and the other is a groove, thereby realizing the circumferential positioning of the first lens 30 in the first kit 10.

The second lens 40 includes the second outer wall 43 surrounding the second light-incident surface 41 and the second light-emitting surface 42, and includes an axial positioning surface 44 extending radially outward from the second outer wall 43, and the axial positioning surface 44 is away from the second light-incident surface 41. The second kit 20 includes the second inner wall 21 and the third limiting surface 22, the second inner wall 21 extends along the axial direction and faces the axis, and the third limiting surface 22 extends radially inward from the second inner wall 21. The second inner wall 21 fits the second outer wall 43, and the third limiting surface 22 fits the axial positioning surface 44 to define the axial position of the second lens 40 in the second kit 20.

In order to define the circumferential position of the second lens 40 in the second kit 20, the second lens 40 is provided with the second clamping portion 45, the second kit 20 is provided with the second clamping connection portion (not shown), and the second clamping portion 45 is clamped with the second clamping portion 45. Specifically, the second clamping portion 45 is arranged on the axial positioning surface 44 and extends along the axial direction, the second clamping connection portion is arranged on the third limiting surface 22 and extends along the axial direction, one of the second clamping portion 45 and the second clamping connection portion is a protrusion, and the other is a groove, thereby realizing the circumferential positioning of the second lens 40 in the second kit 20.

The second kit 20 further includes the second clamping connection outer wall 23 arranged opposite to the second inner wall 21, that is, the second clamping connection outer wall 23 extends along the axial direction and faces away from the axis. The first kit 10 further includes the second-section inner wall 13 and the second limiting surface 14, the second-section inner wall 13 and the first-section inner wall 11 are successively arranged along the axial direction, the first limiting surface 12 and the second limiting surface 14 are provided between the first-section inner wall 11 and the second-section inner wall 13, and the second limiting surface 14 is arranged opposite to the first limiting surface 12. The second-section inner wall 13 is sleeved and connected with the second clamping connection outer wall 23, and the second limiting surface 14 defines the axial position of the second kit 20.

In the examples of the present disclosure, the first lens 30 and the first kit 10 can be bonded together, or other common connection methods may also be used. Similarly, the second lens 40 and the second kit 20 may also be bonded together, or other common connection methods may also be used. As a deformation, the first lens 30 and the first kit 10 can be integrally provided and may be made of the same material or processed by other processing methods for integrally forming, so that both the first kit 10 and the first lens 30 can be made of a light-transmitting material. In order to avoid light waste, light can be set to be impossible to be emitted from the first kit 10, and specifically, methods such as coating or providing reflective paper may be used to prevent light from being emitted from the first kit 10. Similarly, the second lens 40 and the second kit 20 can also be integrally provided and may be made of the same material or processed by other processing methods for integrally forming, so that both the second kit 20 and the second lens 40 can be made of a light-transmitting material. In order to avoid light waste, light can be set to be impossible to be emitted from the second kit 20, and specifically, methods such as coating or providing reflective paper may be used to prevent light from being emitted from the second kit 20.

Both the first kit 10 and the second kit 20 may be in a hollow through cylindrical shape, so that the first lens 30 can be sleeved in the first kit 10, and the first light-incident surface 31 and the first light-emitting surface 32 are not shielded to achieve the normal light distribution function of the first lens 30. Similarly, the second lens 40 can also be sleeved in the second kit 20, and the second light-incident surface 41 and the second light-emitting surface 42 are not shielded to achieve the normal light distribution function of the second lens 40. The first kit 10 includes an accommodation cavity surrounded by the first-section inner wall 11 and the second-section inner wall 13, and includes two openings respectively arranged at both ends of the accommodation cavity. The second kit 20 includes an accommodation cavity surrounded by the second inner wall 21, and includes two openings respectively arranged at both ends of the accommodation cavity. The first kit 10 and the second kit 20 may be metal parts.

The light distribution assembly 100 further includes an elastic part 50, and the elastic part 50 is sleeved between the first kit 10 and the second kit 20, specifically between the second clamping connection outer wall 23 and the second-section inner wall 13, so as to prevent the first kit 10 and the second kit 20 from moving relative to each other along the axial direction. Specifically, the second clamping connection outer wall 23 is provided with the second annular groove 231, the second-section inner wall 13 is provided with the first annular groove 131 along the axial direction, the first annular groove 131 and the second annular groove 231 are flush in the axial direction, and the elastic part 50 is arranged in the space surrounded by the first annular groove 131 and the second annular groove 231. Specifically, the elastic part 50 may be a C-shaped spring. The first annular groove 131 and the second annular groove 231 are circular. In the process of assembling the first kit 10 and the second kit 20, the arc of the C-shaped spring after compression is small, and the C-shaped spring can be completely accommodated in the second annular groove 231. After the first kit 10 and the second kit 20 are sleeved, the extrusion force on the C-shaped spring is cancelled, so that the arc of the C-shaped spring after return is large, and thus the C-shaped spring can be partially placed in the first annular groove 131 and partially placed in the second annular groove 231 to achieve the axial positioning of the first kit 10 and the second kit 20.

In order to facilitate the user to drive the second kit 20 to rotate relative to the first kit 10, the light distribution assembly 100 further includes a driving part 60, and the driving part 60 is connected to the end surface of the second kit 20 away from the first-section inner wall 11 and is located outside the first kit 10 and the second kit 20. In other words, the driving part 60 extends radially outward from the second kit 20, that is, the driving part 60 is exposed outside the first kit 10 and the second kit 20, so as to facilitate the user to align and apply rotating external force.

The driving part 60 includes a radial extension portion 61 and an axial extension portion 62. The radial extension portion 61 extends radially outward from the end surface of the second kit 20, so that the driving part 60 is located outside the first kit 10 and the second kit 20 in the radial direction. The axial extension portion 62 extends from the radial extension portion 61 in the axial direction away from the second kit 20, so as to facilitate the user to grasp.

The light distribution assembly 100 further includes a mounting kit 70, the first kit 10 is sleeved in the mounting kit 70, and the light distribution assembly 100 can be installed into the lighting lamp with use of the mounting kit 70. Specifically, the mounting kit 70 includes a mounting body 71, a mounting flange 72, and a mounting claw 73. The mounting body 71 is in a hollow cylindrical shape, and the mounting flange 72 and the mounting claw 73 are respectively arranged at both ends of the mounting body 71 along the axis. The mounting kit 70 can be made of plastic and other deformable materials. After the expansion of the mounting claw 73, the mounting kit 70 is clamped with the first kit 10, and after the reset of the mounting claw 73, the mounting kit 70 can be in fastening connection with the first kit 10. The mounting flange 72 extends radially outward from the mounting body 71, and at least two sections are arranged separately.

It should be noted that, in the examples of the present disclosure, the rotation of the first kit 10 relative to the second kit 20 may refer to the rotation in the circumferential horizontal direction, or may refer to the rotation in the circumferential inclined direction, which is specifically related to whether the extension direction of the first annular groove 130 on the first kit 10 and the second annular groove on the second kit 20 are horizontal. Therefore, the rotation of the second lens 40 relative to the first lens 30 may refer to the rotation in the circumferential horizontal direction, or may refer to the rotation in the circumferential inclined direction, so that the spacing between the first lens 30 and the second lens 40 in the axial direction may be adjusted.

In the light distribution assembly 100 of the examples of the present disclosure, the number of polarizing lenses may be more than two, such as three, four, or the like, that is, except that the first lens 30 and the second lens 40 are polarizing lenses, the light distribution assembly 100 may also include the third polarizing lens (not shown), the third polarizing lens can be arranged opposite to the first lens 30 and the second lens 40, and the angle of emitting light can also be adjusted in the case that the light source module 220 remains stationary.

Figure 4:
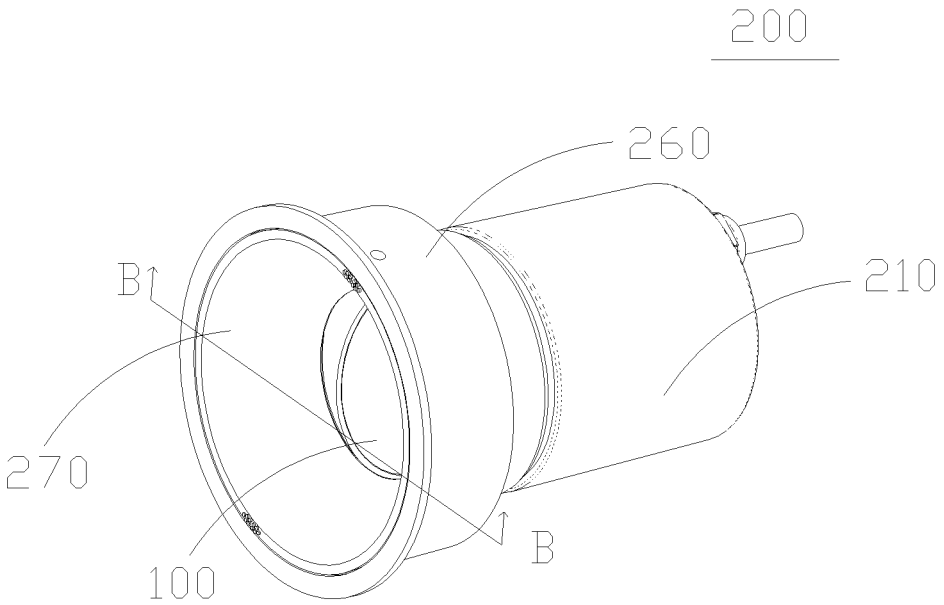
FIG. 4 is a structural diagram of a lighting device in an example 2 of the present disclosure.
Figure 5:
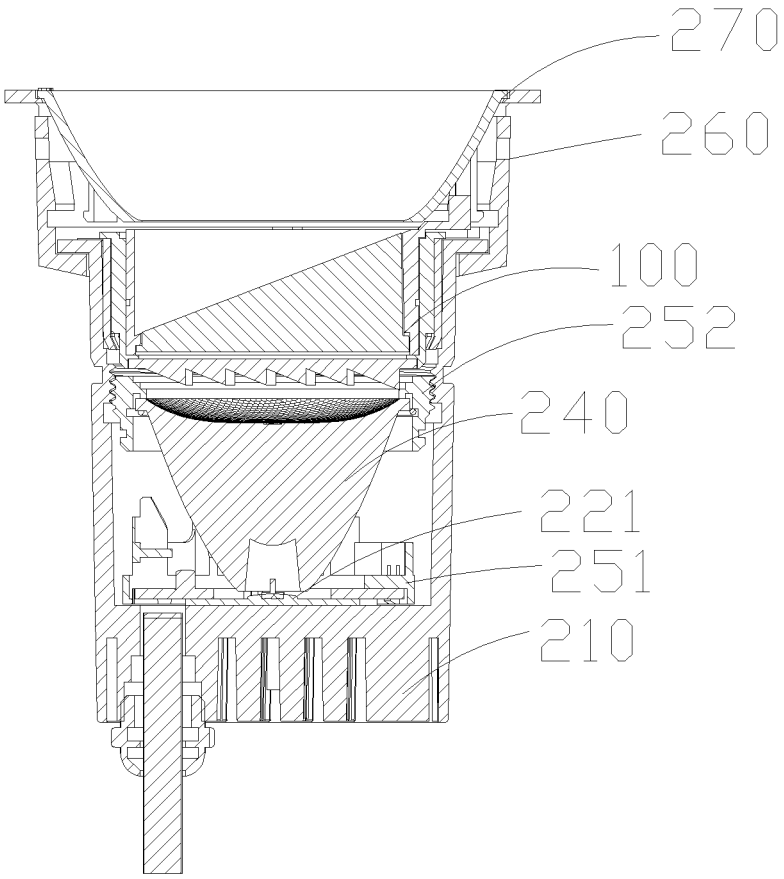
FIG. 5 is a cross-sectional view of the lighting device in FIG. 4 along a line B-B.
Figure 6:
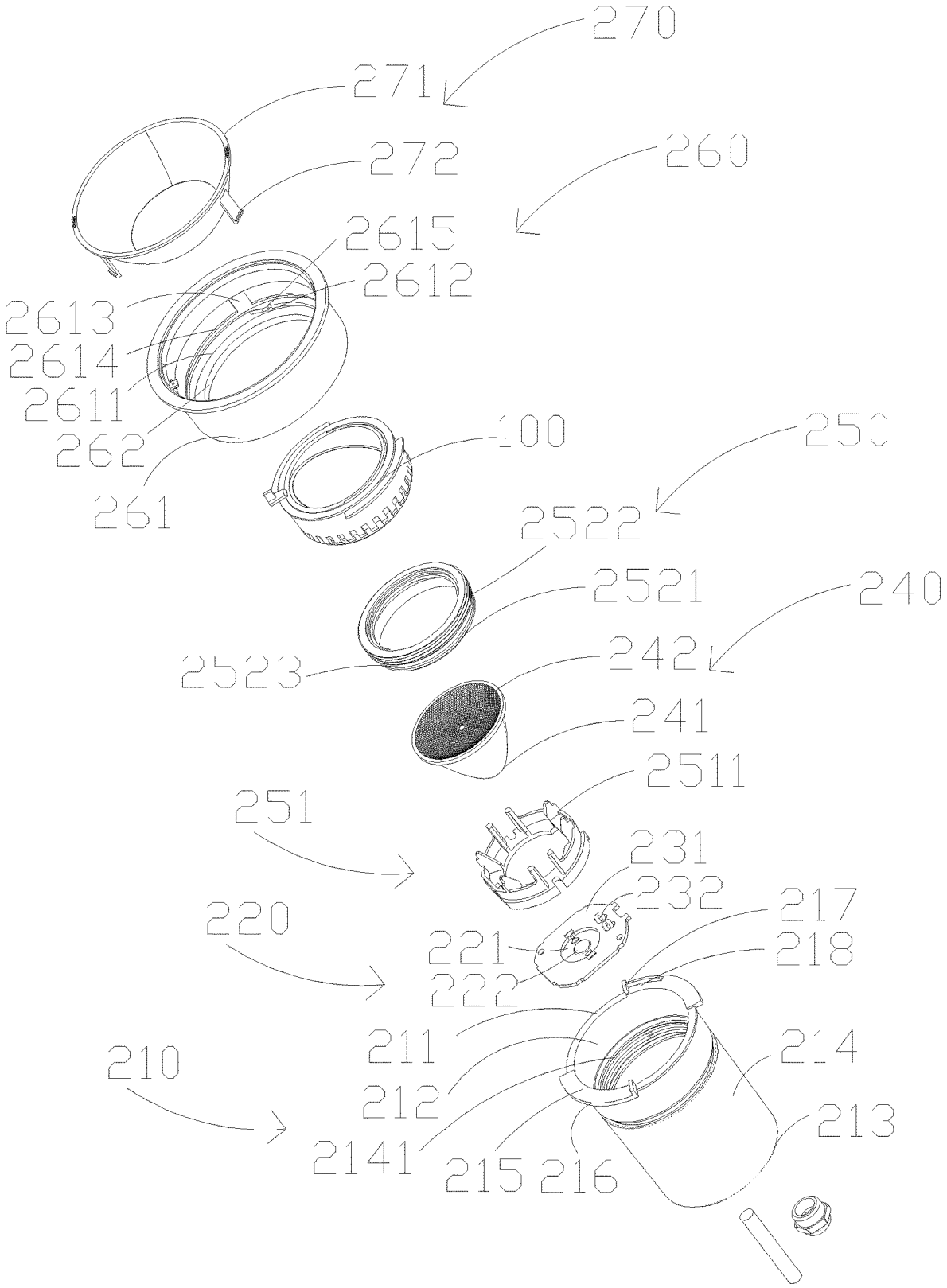
FIG. 6 is an exploded view of the lighting device in FIG. 4.
Figure 7:
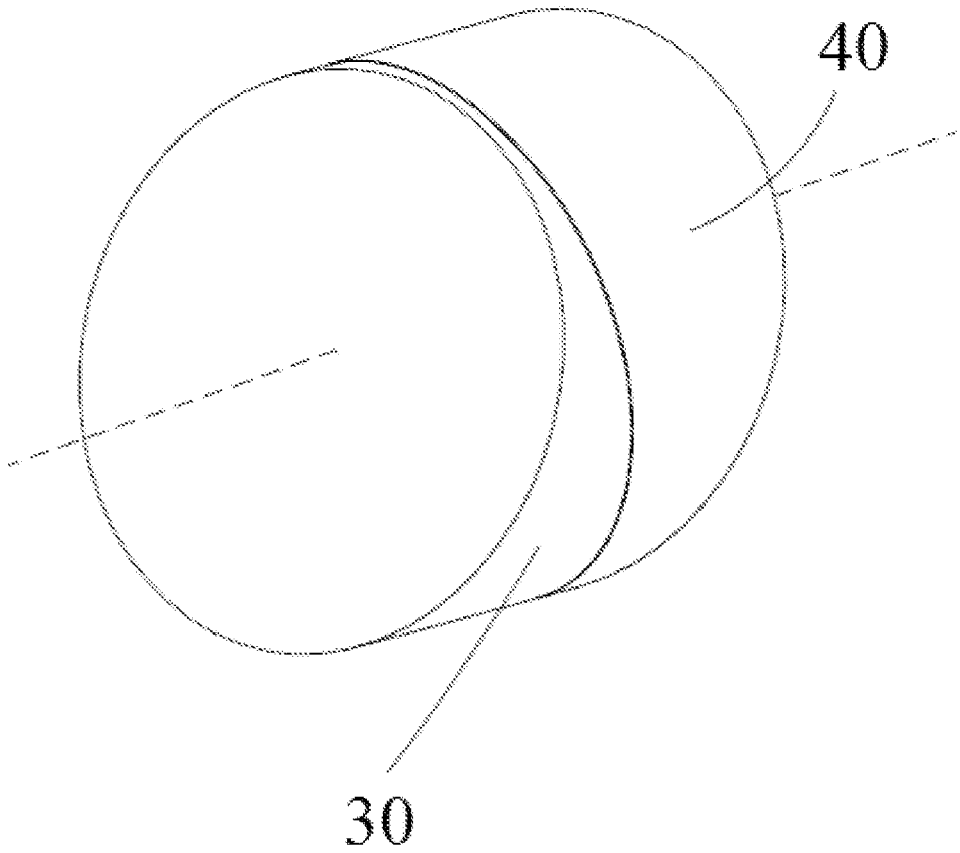
FIG. 7 is a structural diagram of the first lens and the second lens in FIG. 2.
Figure 8:
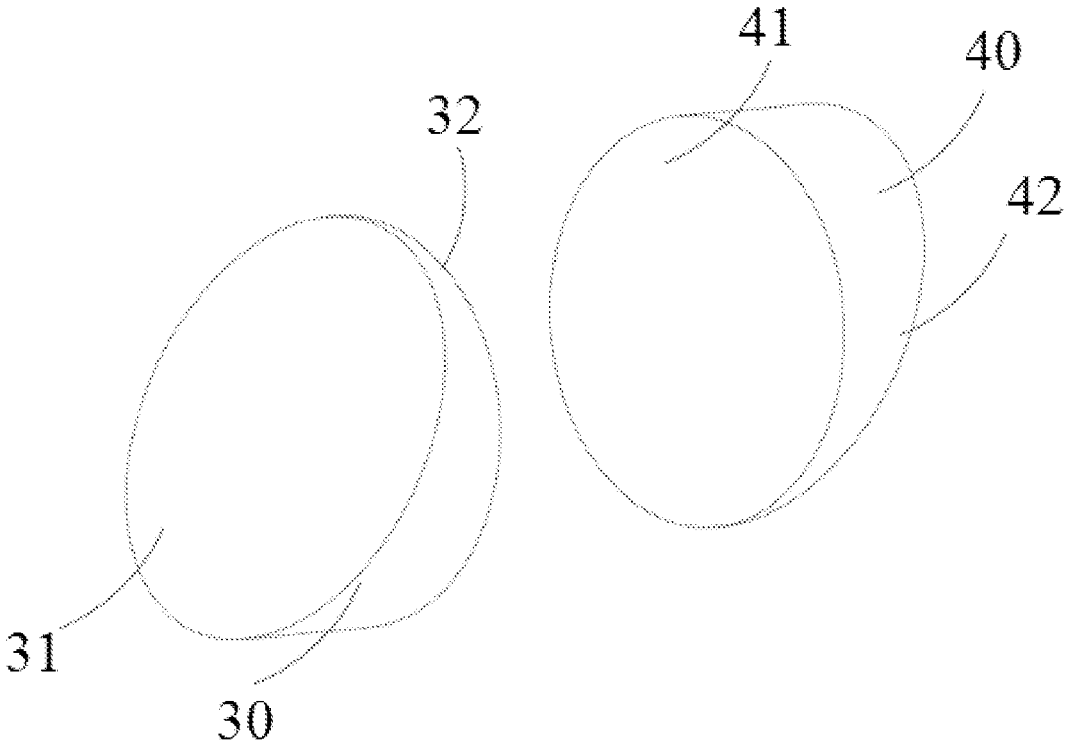
FIG. 8 is an exploded view of the first lens and the second lens in FIG. 7.

As illustrated in FIG. 4 to FIG. 6, the lighting device 200 provided by an example 2 of the present disclosure includes a base 210, a light-emitting assembly, and the light distribution assembly 100 according to the example 1. The base 210 includes a light outlet 211, an accommodation cavity 212 communicated with the light outlet 211, and a bottom wall 213 arranged opposite to the light outlet 211. The light-emitting assembly is arranged in the accommodation cavity 212 and can emit light towards the light outlet 211. The light distribution assembly 100 is connected to the base 210 and is close to the light outlet 211 relative to the light-emitting assembly to distribute light emitted by the light-emitting assembly. In the process of using the lighting device 200, the second kit 20 may be driven to rotate relative to the first kit 10, so as to realize the circumferential rotation of the second lens 40 relative to the first lens 30, thereby changing the deflection direction and deflection angle of the light emitted by the lighting device 200 and adjusting the angle of the light emitted by the lighting device 200.

It should be noted that the first lens 30 in FIG. 5 is a serrated polarizing lens, which is a different light distribution element from the first lens 40, and the actual application is not limited to this.

Specifically, the angle adjustment range of the light emitted by the lighting device 200 may be from 10 degrees to 60 degrees, such as 20 degrees, 30 degrees, 40 degrees or 50 degrees. It can be seen from FIG. 9 to FIG. 11 that the deflection angle of the optical path in FIG. 9 is the largest. If the deflection angle of the light distribution assembly in FIG. 9 is A, and the deflection angle of the light distribution assembly in FIG. 11 is 0, then the adjustable angle of the light emitted by the lighting device 200 of the example 1 is A. Further, in FIG. 9, the first lens 30 and the second lens 40 are the same optical elements, so that both the first lens 30 and the second lens 40 deflect the light by an angle of A/2. It can be seen that the angle adjustment range of the light emitted by the lighting device 200 is related to the first lens 30 and the second lens 40. In the actual product, the adjustment range of the angle of the light emitted by the lighting device 200 can be changed by changing the first lens 30 or the second lens 40.

The light-emitting assembly includes a light source module 220, and the light source module 220 includes a light-emitting sub-module and a power sub-module. The light-emitting sub-module includes a light source plate 221 and a light-emitting unit 222, and the light-emitting unit 222 is arranged on the light source plate 221 and faces the light outlet 211. The power sub-module includes a power board 231 and a component 232, and the component 232 is arranged on the power board 231. The light source plate 221 and the power board 231 are connected and may be located in different planes, and the component 232 is electrically connected with the light-emitting unit 222. The light source plate 221 and the power board 231 may also be arranged in the same plane.

In order to achieve good heat dissipation, the base 210 is made of a metal material, such as aluminum. In addition, the light source plate 221 fits the bottom wall 213, so that the heat of the light source sub-module can be quickly dissipated. A through hole is provided on the bottom wall 213, and a wire passes through the through hole to connect the power sub-module to realize electrical connection. A heat radiating fin is arranged on the outer surface of the bottom wall 213 away from the light source plate 221 to facilitate heat dissipation. In addition, an annular groove may be arranged on the outer surface of the peripheral sidewall 214 to improve the appearance of the base 210.

The light-emitting assembly further includes the third lens 240, the third lens 240 covers the light-emitting unit 222 and includes the third light-incident surface 241 and the third light-emitting surface 242 which are arranged opposite to each other, the third light-incident surface 241 covers the light-emitting unit 222, and the third light-emitting surface 242 faces the first light-incident surface 31 of the first lens 30. Specifically, the third light-incident surface 241 may be an inner concave surface. Therefore, the first light-incident surface 31 which is serrated on the first lens 30 faces the third light-incident surface 241, thereby enabling the structure of the lamp to be more compact.

In order to fix the third lens 240, the light-emitting assembly also includes a lens mounting part and a lens fixing part 252. The lens mounting part is connected to the bottom wall 213 in the accommodation cavity 212 and surrounds the light source plate 221. The lens mounting part includes at least three guiding portions 2511 distributed along the circumferential direction, and the guiding portions 2511 are arranged towards the direction of the light outlet 211 to define the position of the third lens 240 on the radial surface in the accommodation cavity 212. The number of the guiding portions 2511 on the lens mounting part 251 may be four, five, etc., and may be evenly distributed along the circumferential direction. The lens mounting part is sleeved between the third lens 240 and the base 210 and has the fourth limiting surface 2521. The fourth limiting surface 2521 faces the edge of the third light-emitting surface 242 in the third lens 240 to define the axial position of the third lens 240. Specifically, the lens fixing part 252 has an external thread 2522, and the peripheral sidewall 214 of the base 210 has an internal thread 2141 matching with the external thread 2522, so that the lens fixing part 252 is arranged in the accommodation cavity 212 of the base 210 through threaded connection. The lens fixing part 252 includes an anti-glare surface 2523, the anti-glare surface 2523 faces away from the fourth limiting surface 2521, the number of the anti-glare surface 2523 is multiple and stepped, and the surface of the anti-glare surface 2523 is coated with a black material.

The base 210 includes the peripheral sidewall 214 and at least two connecting flanges 215. The peripheral sidewall 214 surrounds the light outlet 211 and the accommodation cavity, and is connected to the bottom wall 213. At least two connecting flanges 215 are separated from each other, and the peripheral sidewall 214 extends radially outward at the light outlet 211. As described according to the example 1, the light distribution assembly 100 also includes the mounting kit 70, the mounting kit 70 includes at least two mounting flanges 72, and the at least two mounting flanges 72 are elastic and separated from each other. The light distribution assembly 100 is arranged in the accommodation cavity 212, and each mounting flange 72 is extruded and deformed to be arranged between two connecting flanges 215, that is, each mounting flange 72 is clamped between the two connecting flanges 215, so as to realize the complementary connection between the mounting flange 72 and the connecting flange 215 in the circumferential direction. Specifically, the number of mounting flanges 72 and the number of connecting flanges 215 are equal, which can be three, four, etc. For reliable fixation, the mounting flange 72 and the connecting flange 215 may be evenly distributed along the circumferential direction.

Specifically, in order to improve the connection strength of the mounting flange 72 and the connecting flange 215, a mounting clamping connection portion (not shown) can be arranged on the surface of the mounting flange 72 facing the connecting flange 215, and the mounting clamping portion (not shown) can be arranged on the surface of the connecting flange 215 facing the mounting flange 72. One of the mounting clamping connection portion and the mounting clamping portion is a protrusion, and the other is a groove, so that the mounting flange 72 and the connecting flange 215 can be in clamping connection.

The lighting device 200 may further include a surface ring 260, the surface ring 260 includes a side ring wall 261, the side ring wall 261 includes an inner surface facing the axis, and the surface ring 260 is connected to the base 210 and is away from the bottom wall 213. The inner surface of the surface ring 260 is provided with the first guiding portion 2611 and the third clamping portion 2612. The first guiding portion 2611 is arranged along the axis, and the third clamping portion 2612 is arranged along the circumferential direction. The base 210 further includes a third clamping connection portion 216, and the third clamping connection portion 216 extends radially outward from the connecting flange 215. The third clamping connection portion 216 is guided by the first guiding portion 2611 and then rotates along the axial direction to clamp the third clamping portion 2612.

The base 210 further includes a stop portion 217, and the stop portion 217 is connected to the edge of the third clamping connection portion 216 and extends along the axis. After the third clamping connection portion 216 rotates to clamp the third clamping portion 2612, the stop portion 217 is clamped in the third clamping portion 2612 to prevent the third clamping connection portion 216 from separating from the third clamping portion 2612 after reverse rotation.

Specifically, the base 210 further includes a shrapnel mounting portion 218, and the shrapnel mounting portion 218 is located on the surface of the third clamping connection portion 216 away from the bottom wall 213. The shrapnel (not shown) may be arranged on the shrapnel mounting portion 218 to increase the connection strength between the third clamping portion 2612 and the third clamping connection portion 216. Correspondingly, the surface ring 260 includes a notch 2615, the notch 2615 is arranged on the third clamping portion 2612, and the third clamping connection portion 216 is guided by the first guiding portion 2611 and then rotates to clamp the third clamping portion 2612 in the axial direction, so that the shrapnel can spring up at the notch 2615. In the case that the third clamping connection portion 216 is needed to be screwed out of the third clamping portion 2612, the shrapnel can be extruded through the notch 2615, thereby reducing the connection strength between the surface ring 260 and the base 210 and facilitating the separation.

The lighting device 200 further includes a reflector 270, and the reflector 270 includes a reflection body 271 and a fourth clamping connection portion 272. The reflection body 271 includes a reflection surface and a backlight surface which are arranged opposite to each other, and includes a reflection inlet and a reflection outlet which are arranged opposite to each other. The reflector 270 is accommodated in the surface ring 260, and the reflection inlet is close to the light source module 220 relative to the reflection outlet. The fourth clamping connection portion 272 is connected to the backlight surface. The surface ring 260 also includes a bottom ring surface 262, a second guiding portion 2613, and a fourth clamping portion 2614. The second guiding portion 2613 and the fourth clamping portion 2614 are arranged on the side ring wall 261. The bottom ring surface 262 is connected to the side ring surface and is arranged on the side of the connecting flange 215 close to the bottom wall 213, and the second guiding portion 2613 and the fourth clamping portion 2614 is away from the bottom wall 213 relative to the first guiding portion 2611 and the third clamping portion 2612. The second guiding portion 2613 is arranged along the axis, the fourth clamping portion 2614 is arranged along the circumferential direction, and the fourth clamping connection portion 272 is guided by the second guiding portion 2613 and then clamps the fourth clamping portion 2614.

The present disclosure provides a light distribution assembly and a lighting device.

The light distribution assembly provided by the present disclosure comprises a first lens, a second lens, a first kit, and a second kit, the first lens is disposed on the first kit, the second lens is disposed on the second kit, the second kit is disposed on the first kit and is rotatable relative to the first kit to allow the second lens to be rotatable relative to the first lens, and at least one of the first lens and the second lens is a polarizing lens to change a light distribution path of the light distribution assembly.

For the light distribution assembly described above, the first lens comprises a first light-incident surface and a first light-emitting surface, the second lens comprises a second light-incident surface and a second light-emitting surface, and the first light-emitting surface is parallel to the second light-incident surface.

For the light distribution assembly described above, a rotation route of the first lens ranges from 10 degrees to 360 degrees.

For the light distribution assembly described above, a distance from the first light-emitting surface to the second light-incident surface ranges from 1 mm to 10 mm.

For the light distribution assembly described above, an orthographic projection of the first light-emitting surface on the second light-incident surface overlaps with the second light-incident surface.

For the light distribution assembly described above, the first light-emitting surface and the second light-incident surface are flat surfaces; the first lens further comprises a first light-incident surface opposite to the first light-emitting surface, and the second lens further comprises a second light-emitting surface opposite to the second light-incident surface; and during rotation of the first lens relative to the second lens, an included angle between a surface where the first light-incident surface is located and a surface where the second light-emitting surface is located changes, and a deflection angle of an optical path of the light distribution assembly changes.

For the light distribution assembly described above, the first lens is a serrated polarizing lens, a wedge-shaped polarizing lens, a curved polarizing lens, or a polarizing lens formed by a combination of at least two of the serrated polarizing lens, the wedge-shaped polarizing lens, and the curved polarizing lens; and the second lens is a serrated polarizing lens, a wedge-shaped polarizing lens, a curved polarizing lens, or a polarizing lens formed by a combination of at least two of the serrated polarizing lens, the wedge-shaped polarizing lens, and the curved polarizing lens.

For the light distribution assembly described above, the first lens is bonded within the first kit, and/or the second lens is bonded within the second kit; or the first lens and the first kit are integrally provided, and/or the second lens and the second kit are integrally provided.

For the light distribution assembly described above, the first lens is provided with a first clamping portion, the first kit is provided with a first clamping connection portion, and the first clamping portion is matched with the first clamping connection portion to define a position of the first lens in the first kit along a circumferential direction; and/or the second lens is provided with a second clamping portion, the second kit is provided with a second clamping connection portion, and the second clamping portion is matched with the second clamping connection portion to define a position of the second lens in the second kit along a circumferential direction.

For the light distribution assembly described above, the light distribution assembly further comprises a driving part, and the driving part is connected to an end surface of the second kit away from the first lens and is disposed outside the first kit and the second kit.

For the light distribution assembly described above, the light distribution assembly further comprises an elastic part, the elastic part is sleeved between the second kit and the first kit to prevent the first kit and the second kit from moving relative to each other along an axial direction.

For the light distribution assembly described above, the light distribution assembly further comprises a mounting kit, and the first kit is sleeved in the mounting kit.

For the light distribution assembly described above, the light distribution assembly further comprises a third polarizing lens, and the third polarizing lens is rotatable relative to the first lens and the second lens.

The present disclosure provides a lighting device, and the lighting device comprises a base, a light-emitting assembly, and the light distribution assembly according to any one of the above; the base comprises a light outlet, an accommodation cavity communicated with the light outlet, and a bottom wall opposite to the light outlet; the light-emitting assembly is disposed in the accommodation cavity and emits light towards the light outlet; and the light distribution assembly is connected to the base and is close to the light outlet relative to the light-emitting assembly to distribute light for the light-emitting assembly.

For the lighting device described above, the light-emitting assembly comprises a light source module, the light source module comprises a light-emitting sub-module and a power sub-module, the light-emitting sub-module comprises a light source plate and a light-emitting unit disposed on the light source plate, and the power sub-module comprises a power board and a component disposed on the power board.

For the lighting device described above, the component is electrically connected to the light-emitting unit; and the light source plate and the power board are connected and located in different planes, or the light source plate and the power board are integrally provided.

For the lighting device described above, the light-emitting assembly further comprises a third lens, the third lens covers the light-emitting unit and comprises a third light-incident surface and a third light-emitting surface which are arranged opposite to each other, and the third light-emitting surface faces the first light-incident surface of the first lens.

For the lighting device described above, the light-emitting assembly further comprises a lens mounting part and a lens fixing part; the lens mounting part is connected to the bottom wall and surrounds the light source plate, the lens mounting part is provided with at least three guiding portions distributed along a circumferential direction, and the guiding portions are arranged towards the light outlet to define a position of the third lens; the lens fixing part is sleeved between the third lens and the base, and is provided with a fourth limiting surface; and the fourth limiting surface faces an edge of the third light-emitting surface to define an axial position of the third lens.

For the lighting device described above, the light distribution assembly further comprises a mounting kit; the first kit is sleeved in the mounting kit; an end of the mounting kit away from the light-emitting assembly is provided with at least two mounting flanges arranged radially outward; the base comprises a peripheral sidewall and at least two connecting flanges, the peripheral sidewall surrounds the light outlet and the accommodation cavity and is connected to the bottom wall, and the at least two connecting flanges extend radially outward from the peripheral sidewall at the light outlet; and the light distribution assembly is disposed in the accommodation cavity, and the mounting flanges and the connecting flanges are in complementary connection in a circumferential direction.

For the lighting device described above, the lighting device further comprises a surface ring, the surface ring comprises a side ring wall, the side ring wall comprises an inner surface facing an axis, and the surface ring is connected to the base and is away from the bottom wall.

For the lighting device described above, the lighting device further comprises a reflector, the reflector comprises a reflection inlet and a reflection outlet, and the reflector is accommodated in the surface ring; and relative to the reflection outlet, the reflection inlet is close to the light-emitting assembly.

The light distribution assembly of the present disclosure comprises a first lens, a second lens, a first kit, and a second kit, at least one of the first lens and the second lens is a polarizing lens, and the first lens and the second lens can rotate relative to each other, so that in the case where the position of the light source remains unchanged, the light distribution path of the light distribution assembly may be changed to adjust the optical path of the light emitted through the light distribution assembly, thereby adjusting the angle of the light emitted by the lighting device.

The present disclosure may include dedicated hardware implementations such as disclosure specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The examples described above further describe the purpose, technical solutions, and beneficial effects of the present disclosure in detail. It should be understood that what have been described above merely are some examples of the present disclosure and are not used to limit the present disclosure. Any modification, equivalent replacement, improvement, or the like made within the spirit and principles of the present disclosure should be within the protection scope of the present disclosure.

What is claimed is:

1. A light distribution assembly, comprising a first lens, a second lens, a first kit, a second kit, and a driving part, wherein: each of the first kit and the second kit is in a hollow through cylindrical shape having two opposite openings, the first lens is sleeved in the first kit, the second lens is sleeved in the second kit, the second kit is sleeved in the first kit and is rotatable relative to the first kit to allow the second lens to be rotatable relative to the first lens, at least one of the first lens and the second lens is a polarizing lens to change a light distribution path of the light distribution assembly, the driving part is fixedly connected to an end surface at an opening of the second kit, the end surface of the second kit that is connected with the driving part is away from the first lens, the driving part extends radially outward from the second kit, wherein the driving part includes a radial extension portion and an axial extension portion, the radial extension extends radially outward from the end surface of the second kit and the driving part is located outside the first kit, and the first lens and the second lens are the same optical elements and are symmetrically assembled to form the light distribution assembly.

2. The light distribution assembly according to claim 1, wherein the first lens comprises a first light-incident surface and a first light-emitting surface, the second lens comprises a second light-incident surface and a second light-emitting surface, and the first light-emitting surface is parallel to the second light-incident surface.

3. The light distribution assembly according to claim 2, wherein a rotation route of the first lens ranges from 10 degrees to 360 degrees.

4. The light distribution assembly according to claim 2, wherein a distance from the first light-emitting surface to the second light-incident surface ranges from 1 mm to 10 mm.

5. The light distribution assembly according to claim 2, wherein an orthographic projection of the first light-emitting surface on the second light-incident surface overlaps with the second light-incident surface.

6. The light distribution assembly according to claim 2, wherein the first light-emitting surface and the second light-incident surface are flat surfaces; the first lens further comprises a first light-incident surface opposite to the first light-emitting surface, and the second lens further comprises a second light-emitting surface opposite to the second light-incident surface; and during rotation of the first lens relative to the second lens, an included angle between a surface where the first light-incident surface is located and a surface where the second light-emitting surface is located changes, and a deflection angle of an optical path of the light distribution assembly changes.

7. The light distribution assembly according to claim 2, wherein the first lens is a serrated polarizing lens, a wedge-shaped polarizing lens, a curved polarizing lens, or a polarizing lens formed by a combination of at least two of the serrated polarizing lens, the wedge-shaped polarizing lens, and the curved polarizing lens; and the second lens is a serrated polarizing lens, a wedge-shaped polarizing lens, a curved polarizing lens, or a polarizing lens formed by a combination of at least two of the serrated polarizing lens, the wedge-shaped polarizing lens, and the curved polarizing lens.

8. The light distribution assembly according to claim 1, wherein:

the first lens is bonded within the first kit, and/or the second lens is bonded within the second kit; or the first lens and the first kit are integrally provided, and/or the second lens and the second kit are integrally provided.

9. The light distribution assembly according to claim 1, wherein:

the first lens is provided with a first clamping portion, the first kit is provided with a first clamping connection portion, and the first clamping portion is matched with the first clamping connection portion to define a position of the first lens in the first kit along a circumferential direction; and/or the second lens is provided with a second clamping portion, the second kit is provided with a second clamping connection portion, and the second clamping portion is matched with the second clamping connection portion to define a position of the second lens in the second kit along a circumferential direction.

10. The light distribution assembly according to claim 1, wherein the light distribution assembly driving part is disposed outside of the first kit and the second kit.

11. The light distribution assembly according to claim 1, wherein the light distribution assembly further comprises an elastic part, the elastic part is sleeved between the second kit and the first kit to prevent the first kit and the second kit from moving relative to each other along an axial direction.

12. The light distribution assembly according to claim 1, wherein the light distribution assembly further comprises a mounting kit, and the first kit is sleeved in the mounting kit.

13. The light distribution assembly according to claim 11, wherein the first kit comprises a first inner wall provided with a first annular groove, the second kit comprises a second inner wall provided with a second annular groove, the elastic part is a C-shaped spring arranged in a space surrounded by the first annular groove and the second groove.

14. A lighting device, comprising a base, a light-emitting assembly, and a light distribution assembly, wherein: the light distribution assembly comprises a first lens, a second lens, a first kit, a second kit, and a driving part, each of the first kit and the second kit is in a hollow through cylindrical shape having two opposite openings, the first lens is sleeved in the first kit, the second lens is sleeved in the second kit, the second kit is sleeved in the first kit and is rotatable relative to the first kit to allow the second lens to be rotatable relative to the first lens, at least one of the first lens and the second lens is a polarizing lens to change a light distribution path of the light distribution assembly, the driving part is fixedly connected to an end surface at an opening of the second kit, the end surface of the second kit that is connected with the driving part is away from the first lens, the driving part extends radially outward from the second kit, wherein the driving part includes a radial extension portion and an axial extension portion, the radial extension extends radially outward from the end surface of the second kit and the driving part is located outside the first kit, and the first lens and the second lens are the same optical elements and are symmetrically assembled to form the light distribution assembly; and the base comprises a light outlet, an accommodation cavity communicated with the light outlet, and a bottom wall opposite to the light outlet; the light-emitting assembly is disposed in the accommodation cavity and emits light towards the light outlet; and the light distribution assembly is connected to the base and is close to the light outlet relative to the light-emitting assembly to distribute light for the light-emitting assembly.

15. The lighting device according to claim 14, wherein the light-emitting assembly comprises a light source module, the light source module comprises a light-emitting sub-module and a power sub-module, the light-emitting sub-module comprises a light source plate and a light-emitting unit disposed on the light source plate, and the power sub-module comprises a power board and a component disposed on the power board.

16. The lighting device according to claim 15, wherein the light-emitting assembly further comprises a third lens, the third lens covers the light-emitting unit and comprises a third light-incident surface and a third light-emitting surface which are arranged opposite to each other, and the third light-emitting surface faces the first light-incident surface of the first lens.

17. The lighting device according to claim 16, wherein the light-emitting assembly further comprises a lens mounting part and a lens fixing part; the lens mounting part is connected to the bottom wall and surrounds the light source plate, the lens mounting part is provided with at least three guiding portions distributed along a circumferential direction, and the guiding portions are arranged towards the light outlet to define a position of the third lens; the lens fixing part is sleeved between the third lens and the base, and is provided with a fourth limiting surface; and the fourth limiting surface faces an edge of the third light-emitting surface to define an axial position of the third lens.

18. The lighting device according to claim 14, wherein the light distribution assembly further comprises a mounting kit; the first kit is sleeved in the mounting kit; an end of the mounting kit away from the light-emitting assembly is provided with at least two mounting flanges arranged radially outward; the base comprises a peripheral sidewall and at least two connecting flanges, the peripheral sidewall surrounds the light outlet and the accommodation cavity and is connected to the bottom wall, and the at least two connecting flanges extend radially outward from the peripheral sidewall at the light outlet; and the light distribution assembly is disposed in the accommodation cavity, and the mounting flanges and the connecting flanges are in complementary connection in a circumferential direction.

19. The lighting device according to claim 14, wherein the lighting device further comprises a surface ring, the surface ring comprises a side ring wall, the side ring wall comprises an inner surface facing an axis, and the surface ring is connected to the base and is away from the bottom wall.

20. The lighting device according to claim 19, wherein the lighting device further comprises a reflector, the reflector comprises a reflection inlet and a reflection outlet, and the reflector is accommodated in the surface ring; and relative to the reflection outlet, the reflection inlet is close to the light-emitting assembly.

* * * * *